US007768470B2

(12) United States Patent
Qin et al.

(10) Patent No.: US 7,768,470 B2
(45) Date of Patent: Aug. 3, 2010

(54) ULTRA WIDEBAND ANTENNA

(75) Inventors: Xiang-Hong Qin, Shenzhen (CN); Jia-Lin Teng, Tu-Cheng (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 441 days.

(21) Appl. No.: 11/847,357

(22) Filed: Aug. 30, 2007

(65) Prior Publication Data

US 2008/0218426 A1 Sep. 11, 2008

(30) Foreign Application Priority Data

Mar. 8, 2007 (CN) ..... 2007 1 0200260

(51) Int. Cl.
*H01Q 13/10* (2006.01)

(52) U.S. Cl. ..... 343/767; 343/700 MS; 343/770; 343/795; 343/846

(58) Field of Classification Search ..... 343/700 MS, 343/767, 769, 829, 846, 770, 795
See application file for complete search history.

(56) References Cited

U.S. PATENT DOCUMENTS

| | | | | |
|---|---|---|---|---|
| 7,042,401 | B2 * | 5/2006 | Park et al. | 343/700 MS |
| 7,061,442 | B1 * | 6/2006 | Tang et al. | 343/767 |
| 7,116,276 | B2 * | 10/2006 | Lee | 343/700 MS |
| 7,132,985 | B2 * | 11/2006 | Lin | 343/700 MS |
| 7,173,564 | B2 * | 2/2007 | Park et al. | 343/700 MS |
| 7,176,837 | B2 * | 2/2007 | Sonoda et al. | 343/700 MS |
| 7,365,686 | B2 * | 4/2008 | Sakama et al. | 343/700 MS |
| 7,471,256 | B2 * | 12/2008 | Kwon et al. | 343/795 |
| 7,518,559 | B2 * | 4/2009 | Yun et al. | 343/702 |
| 7,545,339 | B2 * | 6/2009 | Ratni et al. | 343/830 |
| 7,557,755 | B2 * | 7/2009 | Han et al. | 343/700 MS |
| 2002/0135525 | A1 * | 9/2002 | Ikegaya et al. | 343/767 |
| 2007/0290941 | A1 * | 12/2007 | Brown et al. | 343/842 |

FOREIGN PATENT DOCUMENTS

TW M299358 10/2006

OTHER PUBLICATIONS 5.2GHz notched ultra-wideband antenna using slot-type SRR, Electronics Letters vol. 42, Issue 6, Mar. 16, 2006, pp. 315-316.
Folde-notch dual band ultra-wideband, Antennas and Propagation Society International Symposium, 2005IEEE vol. 1B, 2005, pp. 520-523.

* cited by examiner

*Primary Examiner*—Douglas W Owens
*Assistant Examiner*—Chuc D Tran
(74) *Attorney, Agent, or Firm*—Frank R. Niranjan

(57) ABSTRACT

An ultra wideband antenna (20) is disposed on a substrate (10). The substrate includes a first surface (101) and a second surface (102). The ultra wideband antenna includes a radiation body (22), a feeding portion (26), and a grounded portion (28). The radiation body disposed on the first surface is used for transceiving electromagnetic signals. The radiation body includes a semicircle-shaped metal portion (222) and a rectangle-shaped metal portion (224) and defines a slot (24) starting at an edge therein. The feeding portion is electronically connected to the radiation body for feeding signals to the radiation body. The grounded portion is disposed on the second surface.

13 Claims, 5 Drawing Sheets

ULTRA WIDEBAND ANTENNA

BACKGROUND

1. Field of the Inventions

The present invention relates to antennas, and particularly to an ultra wideband (UWB) antenna.

2. Related Art

In recent years, ultra wideband (UWB) communication technology, a communication technology that uses an extremely wide frequency band and allows high-speed broadband wireless communication, has become more and more popular. The UWB communication technology uses a frequency band of 3.1 GHz-10.6 GHz, which enables high-speed communication by exclusively using an extremely wide frequency band of several GHz width.

However, when UWB communication device is operated in the vicinity of with a World Interoperability for Microwave Access (WiMAX) communication device with a working frequency between 4.9-6.0 GHz, the UWB communication device is prone to interference from the WiMAX communication device.

Therefore, a heretofore unaddressed need exists in the industry to overcome the aforementioned deficiencies and inadequacies.

SUMMARY

One aspect of the present invention provides an ultra wideband antenna. The ultra wideband antenna is disposed on a substrate. The substrate includes a first surface and a second surface. The ultra wideband antenna includes a radiation body, a feeding portion, and a grounded portion. The radiation body disposed on the first surface is used for transceiving electromagnetic signals. The radiation body includes a semicircle-shaped metal portion and a rectangle-shaped metal portion and defines a slot starting at an edge therein. The feeding portion is electronically connected to the radiation body for feeding signals to the radiation body. The grounded portion is disposed on the second surface.

Other objectives, advantages and novel features of the present invention will be drawn from the following detailed description of preferred embodiments of the present invention with the attached drawings, in which:

DETAILED DESCRIPTION OF THE EMBODIMENTS

Figure 1:
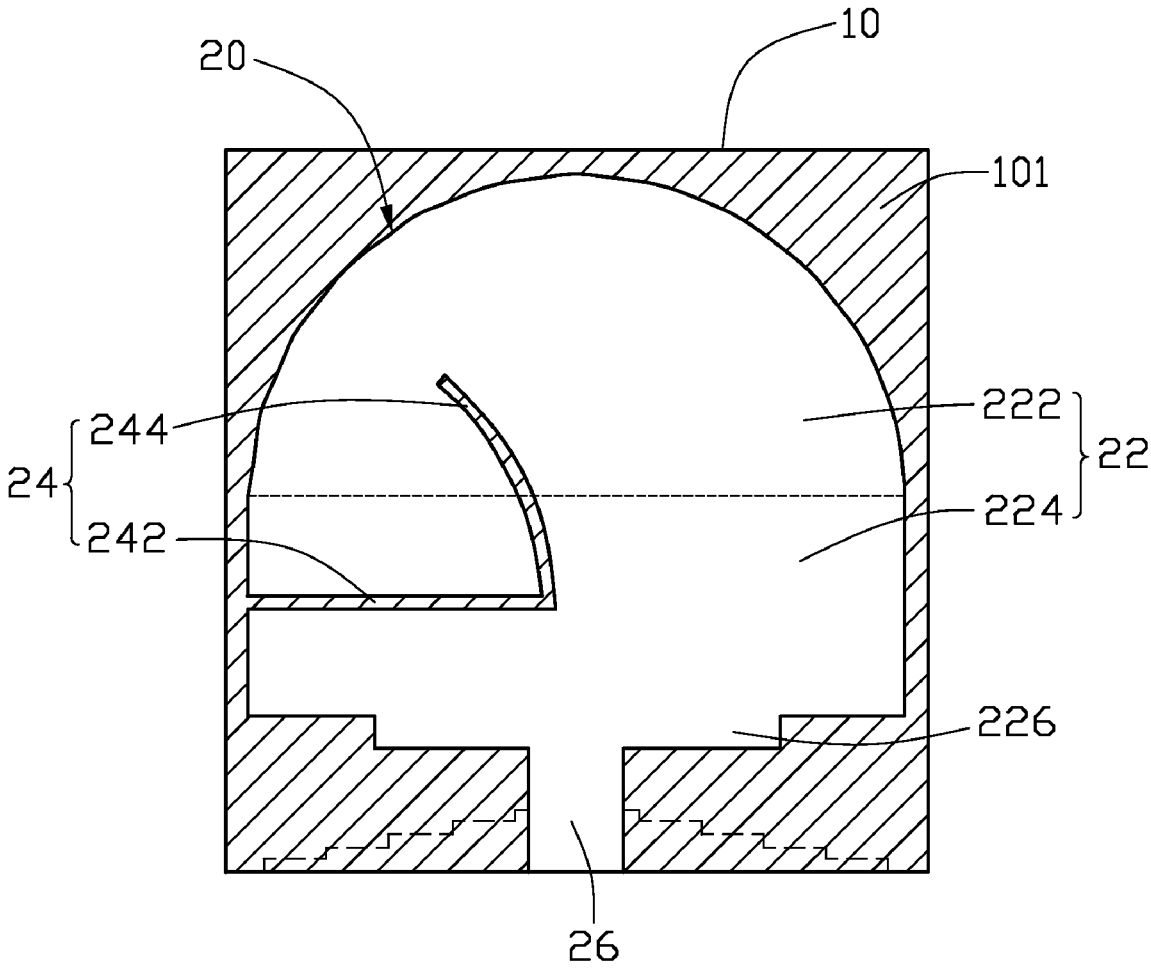
FIG. 1 is a front view schematic diagram of an ultra wideband antenna in accordance with an embodiment of the invention.
Figure 2:
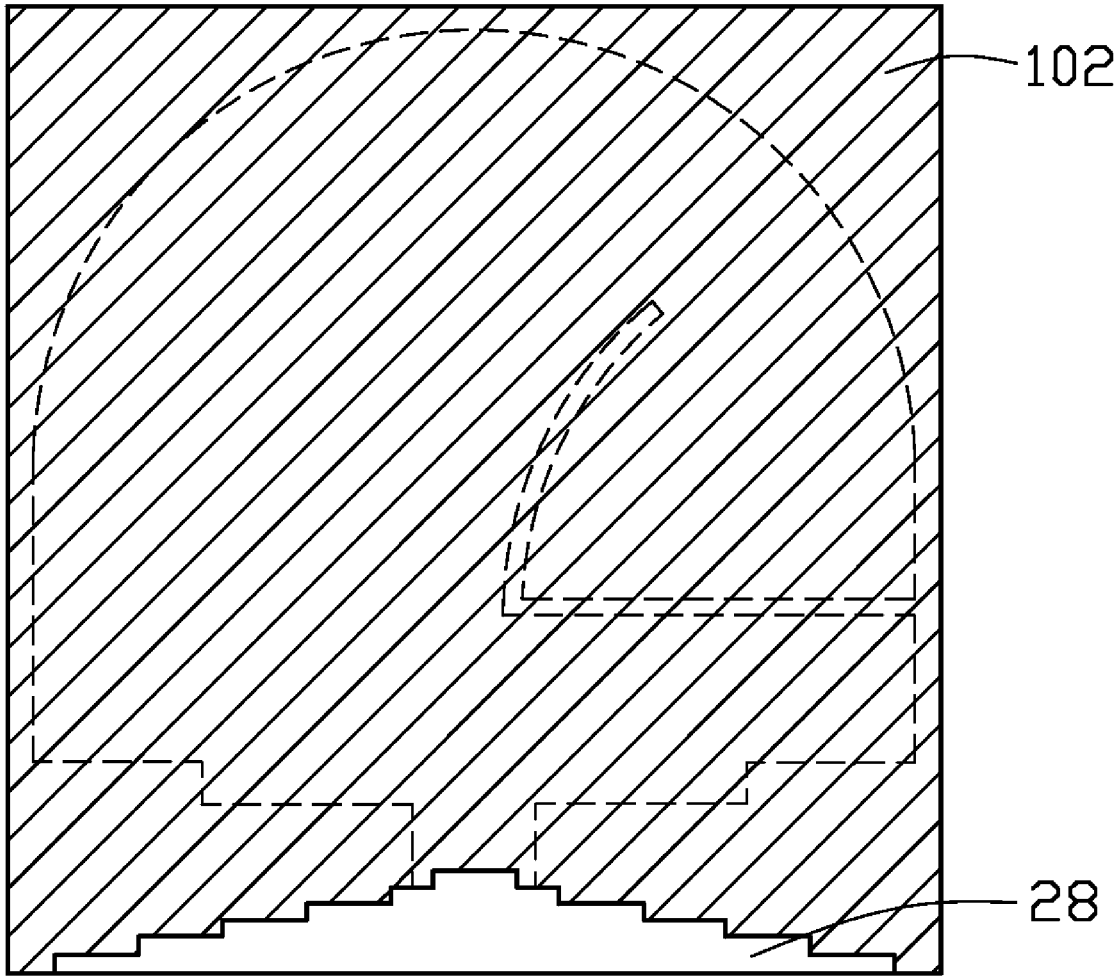
FIG. 2 is a back view schematic diagram of the ultra wideband antenna of FIG. 1.

FIG. 1 and FIG. 2 respectively show front and back view schematic diagrams of an ultra wideband antenna 20 in accordance with an embodiment of the invention.

In the embodiment, the ultra wideband antenna 20 is disposed on a substrate 10. The substrate 10 includes a first surface 101 (FIG. 1) and a second surface 102 (FIG. 2) on a side of the substrate opposite to the first surface 101. The ultra wideband antenna 20 includes a radiation body 22, a feeding portion 26, and a grounded portion 28.

The radiation body 22 is disposed on the first surface 101, and is used for transceiving electromagnetic signals. The radiation body 22 includes a semicircle-shaped metal portion 222 and a rectangle-shaped metal portion 224. A length of the rectangle-shaped metal portion 224 is substantially equal to the diameter of the semicircle-shaped metal portion 222. A connecting portion 226 is rectangle-shaped, and electronically connects the radiation body 22 with the feeding portion 26. In this embodiment, the length and the width of the connecting portion 226 are smaller than those of the rectangle-shaped metal portion 224, respectively. The connecting portion 226 has a function of matching impedances.

The radiation body 22 defines a slot 24 therein, which can reject certain frequency band signals, such as a signals with frequencies of 4.9-6.0 GHz, and thereby avoid interference caused by the certain frequency band signals. In this embodiment, the slot 24 includes a straight slot 242 and an arc slot 244 communicated with the straight slot 242. The straight slot 242 substantially extends from a center of one edge of the rectangle-shaped metal portion 224 toward an opposite edge thereof, terminating near a middle portion of the rectangle-shaped metal portion 224. The straight slot 242 is substantially perpendicular to the feeding portion 26. The arc slot 244 communicates to the straight slot 242 at the middle portion towards an edge of the semicircle-shaped metal portion 222. The arc center of the arc slot 244 is at the end of the straight slot 242 at the center of one edge of the rectangle-shaped metal portion 224, and an arc radius of the arc slot 244 is substantially equal to the length of the straight slot 242.

Referring to FIG. 2, the grounded portion 28 is step-shaped and symmetrical along an axis, and the projection of the axis on the first surface 101 and the feeding portion 26 partially overlap.

Figure 3:
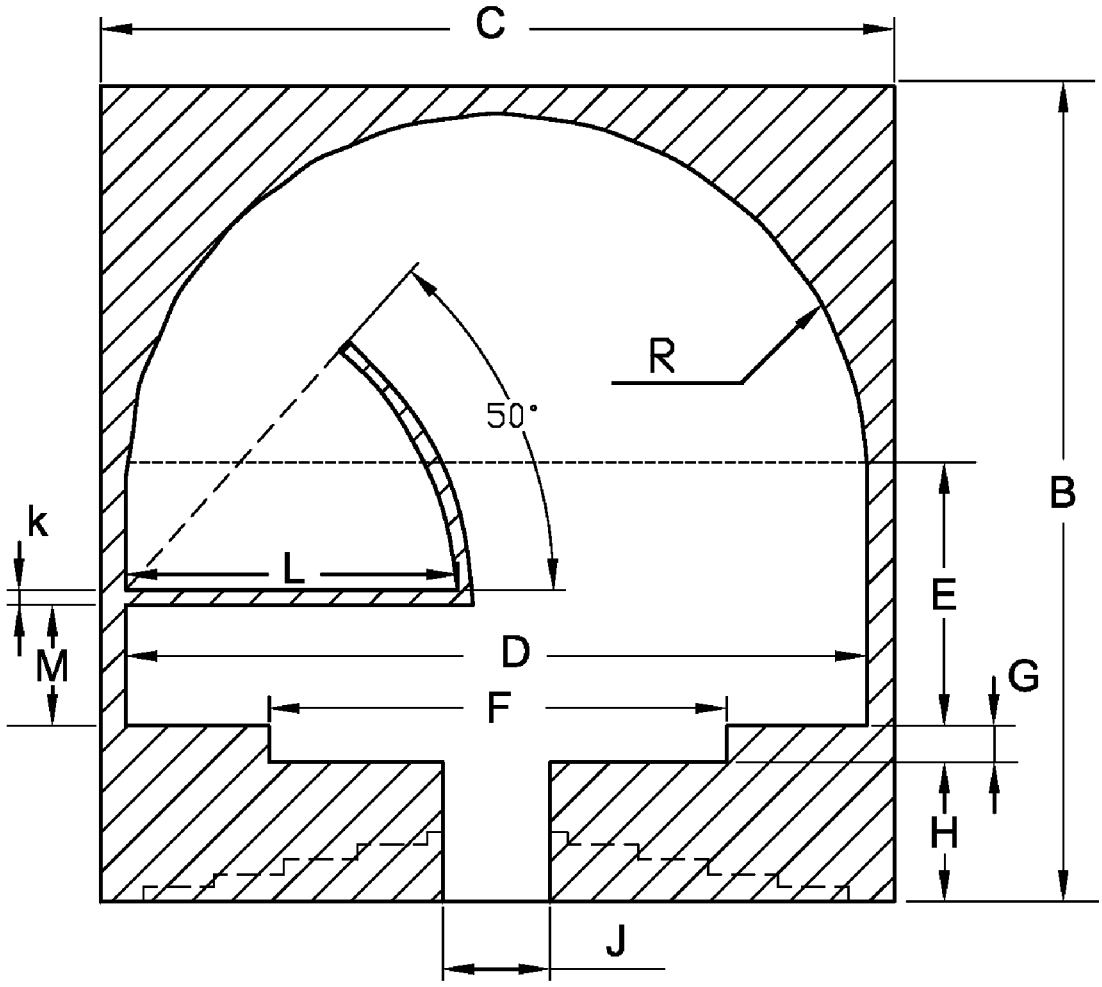
FIG. 3 and FIG. 4 are schematic diagrams illustrating dimensions of the ultra wideband antenna of FIG. 1 and FIG. 2.
Figure 4:
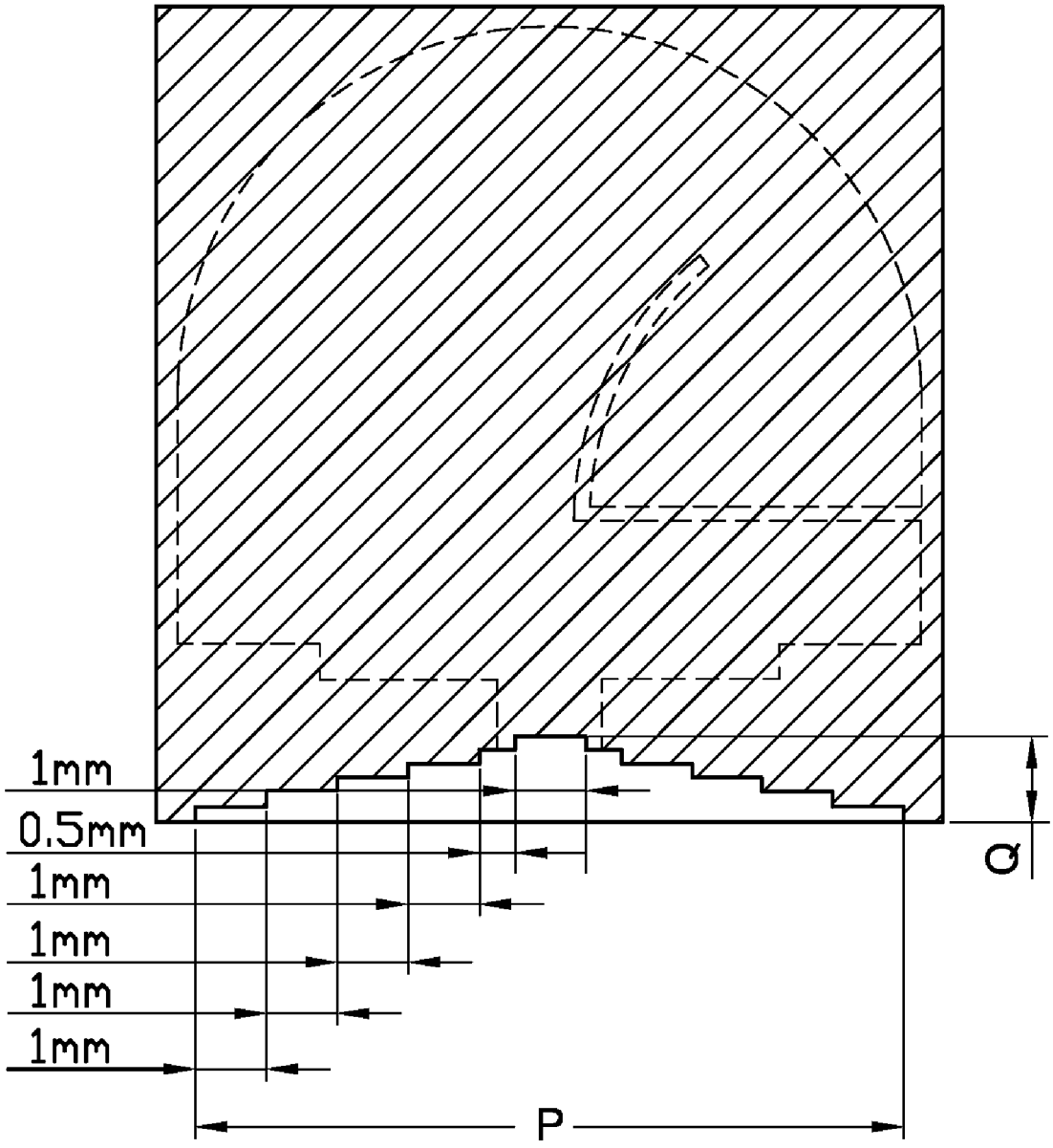

FIG. 3 and FIG. 4 are schematic diagrams illustrating dimensions of the ultra wideband antenna 20 of FIG. 1 and FIG. 2.

In the embodiment, a total length B of the ultra wideband antenna 20 is about 13.5 mm, and a total width C of the ultra wideband antenna 20 is about 11 mm. A radius R of the semicircle-shaped metal portion 222 is about 5.25 mm. A length D of the rectangle-shaped metal portion 224 is about 10.5 mm, and a width E of the rectangle-shaped metal portion 224 is about 5.25 mm. A length F of the connecting portion 226 is about 6.5 mm, and a width G of the connecting portion 226 is about 0.5 mm. A length H of the feeding portion 26 is about 2 mm, and a width J of the feeding portion 26 is about 1.37 mm. A width K of the slot 24 is about 0.2 mm. A length L of the straight slot 242 is about 5.15 mm, and a central angle of the arc slot 244 is about 50 degree. A horizontal distance M between the straight slot 242 and the connecting portion 226 is about 1.75 mm.

One of ordinary skills in the art may change a width of the rejection band by modifying the width of the slot 24, and change a center frequency of the rejection band by modifying the length of the slot 24. The wider the slot 24 is, the wider the rejection band is. The longer the slot 24 is, the lower the center frequency of the rejection band is.

In FIG. 4, a total height N of the grounded portion 28 is about 1.2 mm, and a total width P of the grounded portion 28 is about 10 mm. The grounded portion 28 is step-shaped. The grounded portion 28 has 6 steps, and a height of each step is about 0.2 mm. A width of the fifth step is about 0.5 mm, and widths of the other steps are about 1 mm.

In other embodiments, the grounded portion 28 may be other shaped so long as the overall dimensions remain at about 1.2 mm high by about 10 mm wide.

Figure 5:
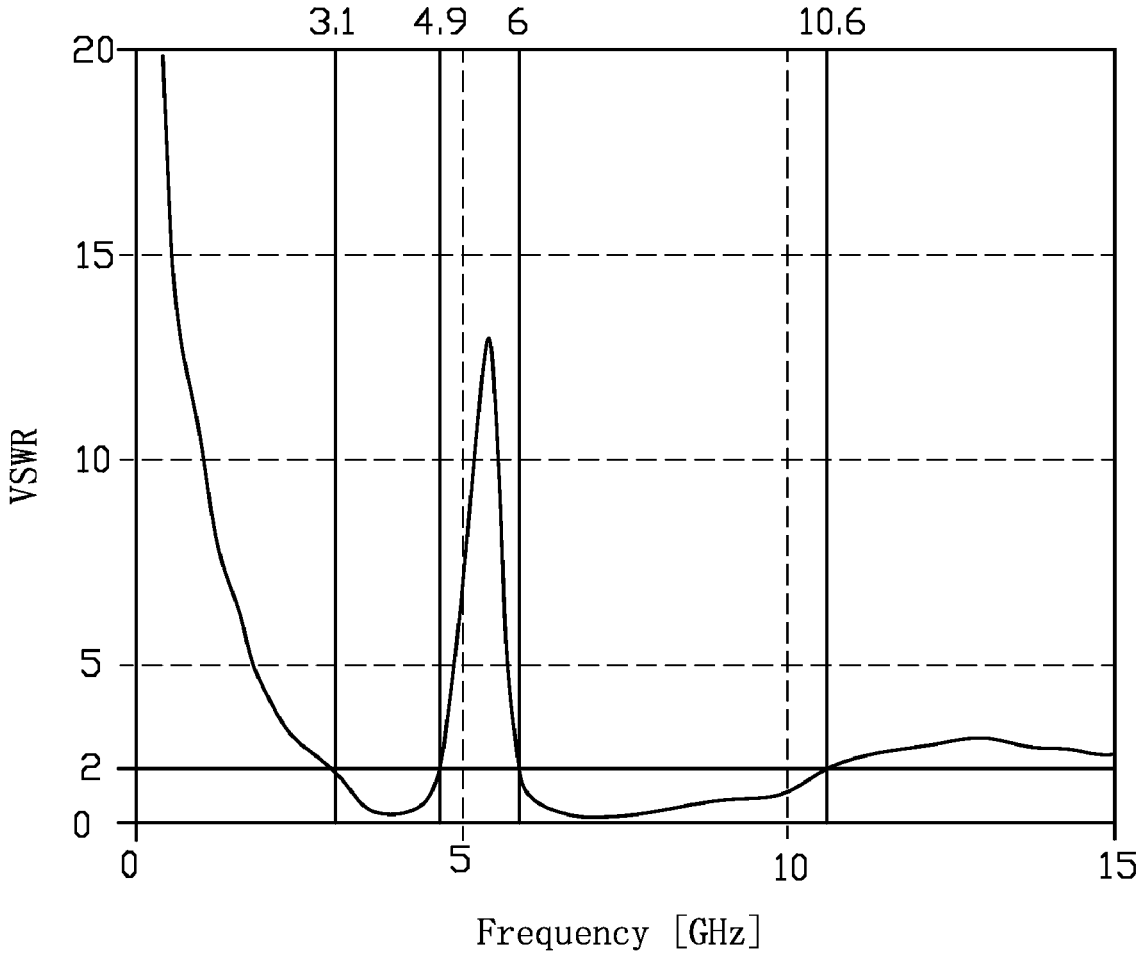
FIG. 5 is a graph of test results showing voltage standing wave ratio (VSWR) of the ultra wideband antenna of FIG. 1 and FIG. 2.

FIG. 5 is a graph of test results showing voltage standing wave ratio (VSWR) of the ultra wideband antenna 20 of FIG. 1 and FIG. 2. A horizontal axis represents the frequency (in GHz) of the electromagnetic signals traveling through the ultra wideband antenna 20, and a vertical axis represents amplitude of VSWR. A curve shows the amplitudes of VSWR of the ultra wideband antenna 20 at operating frequencies. As shown in FIG. 5, the ultra wideband antenna 20 performs well when operating at frequencies of 3.1-4.9 GHz and 6.0-10.6 GHz. The amplitudes of the VSWR in the band pass frequency range are smaller than a value of 2, indicating that the ultra wideband antenna 20 complies with know standards of operation of ultra wideband antennas. Referring to FIG. 5, the ultra wideband antenna 20 rejects WiMAX frequencies of 4.9-6.0 GHz.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An ultra wideband antenna disposed on a substrate comprising a first surface and a second surface, the ultra wideband antenna comprising:

a radiation body, disposed on the first surface, for transceiving electromagnetic signals, the radiation body comprising a semicircle-shaped metal portion and a rectangle-shaped metal portion, and defining a slot starting at an edge therein, wherein the slot comprises a straight slot and an arc slot, the straight slot substantially extends from a center of one edge of the rectangle-shaped metal portion toward an opposite edge thereof, and the arc slot communicates to the straight slot, and extends from the rectangle-shaped metal portion toward an edge of the semicircle-shaped metal portion;

a feeding portion, electronically connected to the radiation body, for feeding signals to the radiation body; and a grounded portion, disposed on the second surface.

2. The ultra wideband antenna as recited in claim 1, further comprising a connecting portion for electronically connecting the radiation body with the feeding portion.

3. The ultra wideband antenna as recited in claim 2, wherein the connecting portion is rectangle-shaped.

4. The ultra wideband antenna as recited in claim 1, wherein a length of the rectangle-shaped metal portion is substantially equal to a diameter of the semicircle-shaped metal portion.

5. The ultra wideband antenna as recited in claim 1, wherein the straight slot is substantially perpendicular to the feeding portion.

6. The ultra wideband antenna as recited in claim 1, wherein an arc radius of the arc slot is substantially equal to a length of the straight slot.

7. The ultra wideband antenna as recited in claim 1, wherein the grounded portion is step-shaped and symmetrical along an axis, and the projection of the axis on the first surface and the feeding portion partially overlap.

8. An antenna assembly comprising:

a substrate comprising a first surface and a second surface opposite to said first surface; and an antenna attachably formed on said substrate, said antenna comprising a radiation body disposed on said first surface of said substrate for transceiving electromagnetic signals, said radiation body comprising a semicircle-shaped metal portion formed along a first side of said radiation body, said antenna further comprising a feeding portion electrically connectable with said radiation body at a second side of said radiation body opposite to said first side of said radiation body for feeding signals to said radiation body, wherein a slot is defined in said radiation body starting at an edge of said radiation body different from said first and second sides of said radiation body, said slot comprises a straight slot and an arc slot, said straight slot extends from said edge into said radiation body, and said arc slot spatially communicates with said straight slot and extends from said straight slot toward said semicircle-shaped metal portion of said radiation body.

9. The antenna assembly as recited in claim 8, wherein said radiation body comprises a rectangle-shaped metal portion defined between said semicircle-shaped metal portion and said second side of said radiation body.

10. The antenna assembly as recited in claim 8, wherein an arc radius of said arc slot is substantially equal to a length of said straight slot.

11. The antenna assembly as recited in claim 8, wherein said antenna further comprises a grounded portion disposed on said second surface of said substrate.

12. An antenna assembly comprising:

a substrate; and an antenna attachably formed on said substrate, said antenna comprising a radiation body disposed on one surface of said substrate for transceiving electromagnetic signals, and a feeding portion electrically connectable with said radiation body for feeding signals to said radiation body, a slot defined in said radiation body starting at an edge of said radiation body, said slot comprising a straight slot extending from said edge into said radiation body, and an arc slot spatially communicating with said straight slot and extending from said straight slot toward another edge of said radiation body different from said edge of said radiation body, wherein said radiation body defines a semicircle-shaped metal portion and a rectangle-shaped metal portion defined between said semicircle-shaped metal portion and said feeding portion, said edge of said radiation body is defined in said rectangle-shaped metal portion, and said another edge of said radiation body is defined in said semicircle-shaped metal portion.

13. The antenna assembly as recited in claim 12, wherein an arc radius of said arc slot is substantially equal to a length of said straight slot.

* * * * *